United States Patent [19]

Griffith

[11] 4,044,582

[45] Aug. 30, 1977

[54] WORK GUIDE FOR PIPE REELING MACHINES AND THE LIKE AND PROCESS FOR TREATING THE SAME

[75] Inventor: Robert G. Griffith, Poland Township, Mahoning County, Ohio

[73] Assignee: Youngstown Sheet and Tube Company, Youngstown, Ohio

[21] Appl. No.: 695,903

[22] Filed: June 14, 1976

[51] Int. Cl.[2] ..... B21B 39/14
[52] U.S. Cl. ..... 72/97; 75/128 R
[58] Field of Search ..... 72/97, 96; 75/128 R

[56] References Cited

U.S. PATENT DOCUMENTS

| | | | |
|---|---|---|---|
| 1,997,469 | 4/1935 | Ornitz | 75/128 R |
| 2,632,234 | 3/1953 | Fitz | 75/128 R |
| 3,496,031 | 2/1970 | Suhy | 75/128 R |
| 3,573,034 | 3/1971 | Denhard | 75/128 R |

*Primary Examiner*—Lowell A. Larson
*Attorney, Agent, or Firm*—John Stelmah

[57] ABSTRACT

A pipe reeling machine guide for guiding and burnishing an external surface of a pipe having a work contact surface of a composition consisting essentially, in percent by weight, of: 0.70–0.90 carbon, up to 1.75 manganese, 0.08 max. phosphorus, 0.08 max. sulfur, 0.5–1.75 silicon, 8–12.0 nickel, 23–27 choromium, and the balance being essentially iron with residual impurities.

5 Claims, 4 Drawing Figures

WORK GUIDE FOR PIPE REELING MACHINES AND THE LIKE AND PROCESS FOR TREATING THE SAME

BACKGROUND OF THE INVENTION

This invention relates to improvements in work guides for pipe reeling machines and the like. The invention further relates to a method of producing reeler machine work guides having increased service life and better performance.

DESCRIPTION OF THE PRIOR ART

In "The Making, Shaping and Treating of Steel", 8th Edition, published by U.S. Steel Corporation (1964), on pages 850–851, there is a description of a typical reeling machine. As indicated there, the reeling machine is somewhat similar in construction and operation to the Mannesmann piercer machine. In operation, a mandrel carrying the reeler plug is placed between the rolls of the reeler. On the inlet side of the reeler, the pipe or tube being processed is carried through stationary guides to contact with the rolls. The elevational position of the tube is properly maintained during reeling by other stationary guides mounted between the reeler rolls above and below the pass of the tube.

In U.S. Pat. No. 2,303,314, there is disclosed a different arrangement of rolls and stationary guides. In that arrangement, a pair of stationary guides are diametrically opposed but at the same elevation as the mill pass line and a third guide is positioned below the pass line. The guides are disclosed as being of massive cast iron.

The reeling mechanism employed in fabricating seamless tubing or pipe typically includes a pair of rolls revolving in the same direction on opposite sides of the reeler mandrel plug and with their axes oppositely inclined, which cause the tube or pipe to rotate and helically advance over the plug. Because of the spacing between the reeler rolls and the reeler plug there is a small reduction made in the wall thickness of the tubing. This reduction effectively burnishes the inside and outside surfaces of and sizes the tubing.

OBJECTS AND SUMMARY OF THE INVENTION

It is the principal object of this invention to provide guides for pipe reeling machines which have increased life. It is another object of this invention to provide a new composition for the work contact surfaces of guides used in pipe reeling machines. It is a further object of this invention to provide a new method for forming pipe reeling machine guides.

Briefly, the objects are attained by fabricating the reeling machine guides from a composition which has not been used in such guides prior to this invention. Instead of the massive cast iron generally employed, the present invention contemplates an alloy steel composition. A typical composition used in fabricating tools for seamless pipe hot mill use is as follows, indicated ranges are in percent by weight: 3.50–3.60 carbon; 0.55–0.75 manganese; 0.10 max. phosphorus; 0.10 max. sulphur; 1.20 silicon; 1.0–1.2 chromium; 0.25–0.30 molybdenum; and the balance essentially iron and residual impurities.

The guides of this invention are also heat treated to provide better toughness and initial surfaces having lubricating qualities.

DESCRIPTION OF THE DRAWING

The invention will be more fully understood and further objects and advantages thereof will become apparent when reference is made to the following detailed description and to the accompanying drawing, in which.

DESCRIPTION OF A PREFERRED EMBODIMENT

This invention is particularly adapted for use in conjunction with reeling machine operations in the manufacture of seamless tubing or pipe. The term "pipe" as used hereinafter includes tubing.

Figure 1:
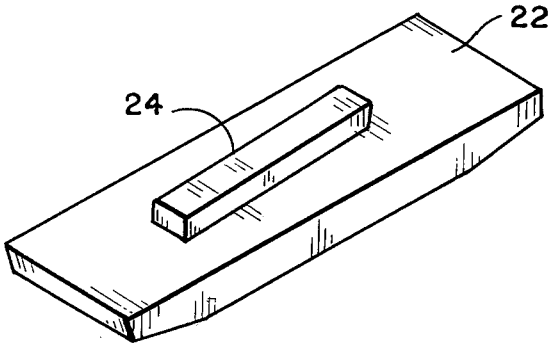
FIG. 1 is a three-dimensional view of one form of reeling machine guide for which this invention is particularly adapted.
Figure 3:
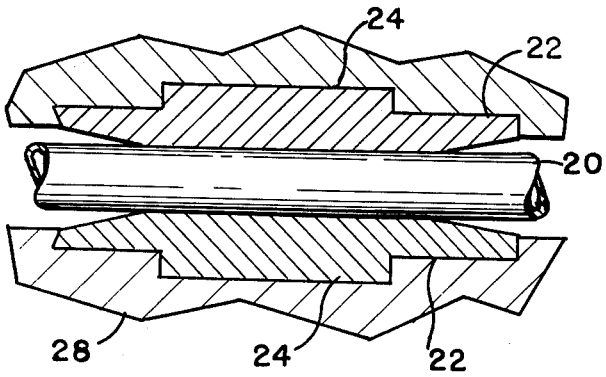
FIG. 3 is a view taken along line 3—3 of FIG. 2, but with the rolls omitted for clarity.
Figure 4:
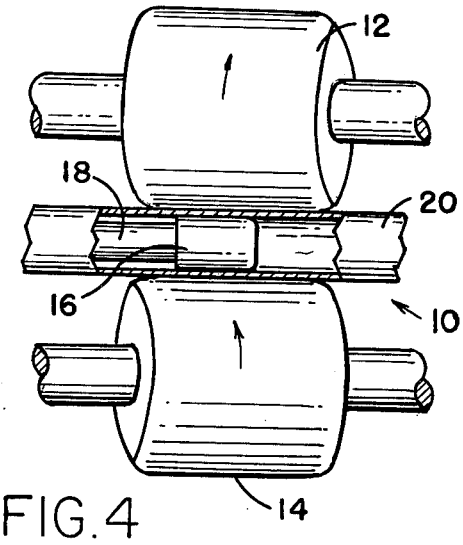
FIG. 4 is a view taken along line 4—4 of FIG. 2, but with the guides omitted.
Figure 2:
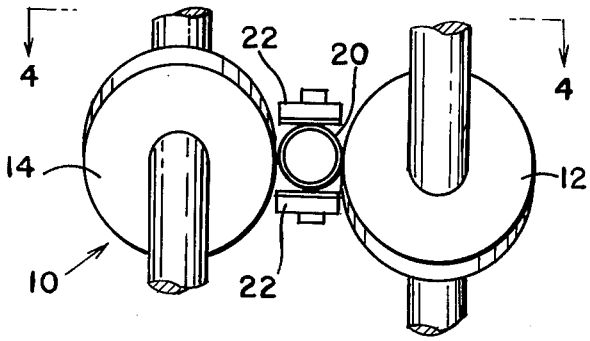
FIG. 2 is a schematic representation of a cross-sectional view of a tube or pipe reeling machine.

Referring first to FIG. 2 of the drawing, the work zone of a reeling machine 10 is schematically illustrated there. The machine 10 includes a pair of rolls 12 and 14 which have their axes oppositely inclined and revolve in the same direction on opposite sides of mandrel plug 16, which may be seen more clearly in FIG. 4, and thereby impart a helical advance to pipe 20. The plug 16 is carried by mandrel 18. As the pipe 20 advances over the plug 16, the interior surface of the pipe is burnished.

In the work zone, between the rolls 12 and 14, there are provided a pair of work guides 22, one being on the top and the other on the bottom side of the pipe or machine pass line. The work guides or shoes 22 are supported in holders 26 and 28, which are generally part of the reeling machine. Each holder has a slot for receiving a lug 24 of the guide 22. The work guides 22 are provided to guide and retain the pipe being worked. The contacting surfaces of the guides also serve to burnish the outside surface of the pipe. Such surfaces are subject to heat and abrasion and, hence, heretofore have had a relatively short life.

The guides of this invention are not limited to any particular configuration but instead are directed to guides having a composition which contributes to an extended life. The cost of changing the guides is reflected in loss of production, direct labor, and loss of direct labor. Although the direct cost of the guides of this invention may be in the order of five times that of prior art guides of the same configuration, it has been found that their useful lives are thirteen to twenty greater than those of the prior art guides.

The work guides of this invention comprise, or have a work contact surface comprising, a composition consisting essentially, in percent by weight, of: 0.70–0.90 carbon, up to 1.75 manganese, 0.08 max. phosphorus, 0.08 max. sulfur, 0.5–1.75 silicon, 8–12.0 nickel, 23–27 chromium, and the balance being essentially iron with residual impurities. A preferred composition is one which contains: 0.70–0.90 carbon, 0.40–0.60 manganese, a max. of 0.05 phosphorus, a max. of 0.05 sulphur, a max. of 1.0 silicon, 12.0 nickel and 25.0 chromium.

The specified ranges of the constituents of the composition of this invention are provided for the following reasons:

The carbon range provides an optimum strength; any additional amount would tend to weaken the alloy steel. The manganese range provides the required strength at optimum economic levels; it is preferred to provide at least 0.4% manganese to facilitate fluidity of the alloy steel during pouring. A 0.5% min. of silicon acts as a deoxidizing agent. A 0.08% max. of sulphur is specified in order to deter "hot-shortness". The phosphorus content of 0.08% max. is provided to limit the brittleness of the steel in a cold state. The 8–12% nickel range provides the necessary strength and enhances the grain size, high temperature and wear resistances; additional amounts would be relatively expensive. The considerations which apply to the selection of the nickel range also apply to the selection of the chromium range. The 12% nickel and 25% chromium are the target percentages for a preferred composition.

The reeler machine tools having the composition of this invention are particularly useful in the fabrication of seamless tubes or pipes comprising low alloy material. The performance of such tools is further enhanced by heat treating the tools in a manner whereby an oxide is formed on the surfaces. This oxide serves as a lubricating film burnishing the pipe surfaces. It is particularly important to have this lubrication during the break-in period of the guides or other reeler machine tools. Without the lubricating oxide film, it is frequently necessary to reject the first few pieces of pipe formed because of surface roughness. The lack of such film also tends to shorten the effective life of the tools.

It has been found that an effective lubricating oxide surface can be formed on reeler machine guides or other tools having the composition of this invention by heating the tools at a temperature of about 2150° F for 1 hour per inch of thickness and then air cooling in still air. Such heat treatment also helps to develop a better toughness characteristic of the alloy composition.

What is claimed is:

1. A pipe reeling machine external guide for guiding and burnishing an external surface of a pipe, said guide having a work contact surface of a composition consisting essentially, in percent by weight, of: 0.70–0.90 carbon; up to 1.75 manganese, 0.08 max. phosphorus, 0.08 max. sulfur, 0.5–1.75 silicon, 8–12.0 nickel, 23–27 chromium, and the balance being essentially iron with residual impurities.

2. A guide, as described in claim 1, wherein said composition consists essentially of:

0.70–0.90 carbon, 0.40–0.60 manganese, 0.05 max. phosphorus, 0.05 max. sulphur, 0.5–1.0 silicon, 12.0 nickel, 25.0 chromium, and the balance being essentially iron with residual impurities.

3. A guide, as described in claim 1, which has been treated after being formed by heating at a temperature of about 2150° F for a time corresponding to about one hour per inch of thickness of the guide and then air cooled.

4. A process for treating a pipe reeling machine external guide which comprises:

heat treating and cooling a guide having an external work contact surface of a steel alloy having a composition consisting essentially, in percent by weight, of:

0.70–0.90 carbon, up to 1.75 manganese, 0.08 max. phosphorus, 0.08 max. sulfur, 0.5–1.75 silicon, 8–12.0 nickel, 23–27 chromium, and the balance being essentially iron with residual impurities, in a manner whereby an oxide is formed on said surface.

5. A process as described in claim 4, wherein: said guide is heat treated to a temperature of about 2150° F for a time corresponding to about 1 hour per inch of thickness, and then air cooled in the absence of a significant reheating step.

* * * * *